United States Patent [19]

Smith, Jr.

[11] Patent Number: 4,654,049

[45] Date of Patent: Mar. 31, 1987

[54] SYNTHETIC LOGS FOR FIREPLACES OR USE AS GENERAL FUEL AND PROCESSES FOR MAKING THEM

[76] Inventor: James B. Smith, Jr., 9204 Navios Dr.; SE., Huntsville, Ala. 35803

[21] Appl. No.: 748,164

[22] Filed: Jun. 24, 1985

[51] Int. Cl.[4] ..... C10L 5/00; C10L 5/36

[52] U.S. Cl. ..... 44/10 B; 44/10 C; 44/14

[58] Field of Search ..... 44/14, 38, 10 R, 10 B, 44/10 C

[56] References Cited

U.S. PATENT DOCUMENTS

| | | | |
|---|---|---|---|
| 143,066 | 9/1873 | Crumpton | 44/38 |
| 229,596 | 7/1880 | Finck | 44/38 |
| 345,217 | 7/1886 | Dimon | 44/14 |
| 415,231 | 11/1889 | Walters | 44/38 |
| 864,525 | 8/1907 | Foreman et al. | 44/14 |
| 1,193,070 | 8/1916 | Roberts | 44/14 X |
| 3,726,652 | 4/1973 | Schick | 44/14 |

*Primary Examiner*—Carl F. Dees

*Attorney, Agent, or Firm*—George J. Porter

[57] ABSTRACT

A manufactured fireplace log for fireplaces or as a general utility fuel and methods for making such logs and comprising an inner core comprised of coal, petroleum coke, or other carbonaceous particles (step 92 of FIG. 9) held together by a first binder of flammable material and covered with a coating of flammable wood or wood derived particles (step 90) bonded to the surface of the inner core (step 94) and held together by a second binder of flammable material which can selectively be of the same or of different material from the material of the first binder.

7 Claims, 9 Drawing Figures

FLOW CHART FOR MAKING FIRELOGS WITH OUTER SHELLS FORMED FROM WOODCHIPS OR SAWDUST

FLOWCHART FOR MAKING FIRELOGS WITH OUTER SHELLS OF STRIPS OF WOOD

FLOWCHART FOR MAKING FIRELOGS WITH OUTER SHELLS OF A SOLID WOOD TUBE

FLOWCHART FOR MAKING INNER CORES OF FIRELOGS FROM ANTHRACITE AND BITUMINOUS COAL

FLOWCHART FOR MAKING INNER CORES OF FIRELOGS WITH PETROLEUM COKE, ALSO KNOWN AS 'STILL BOTTOMS'

FLOWCHART FOR MAKING INNER CORES OF FIRELOGS WITH A MIXTURE OF PETROLEUM COKE, ANTHRACITE COAL, BITUMINOUS COAL AND SUITABLE BINDERS

FLOWCHART FOR MAKING INNER CORES OF FIRELOGS WITH A MIXTURE OF PETROLEUM COKE, WOOD CHIPS, ANTHRACITE COAL AND BITUMINOUS COAL

SYNTHETIC LOGS FOR FIREPLACES OR USE AS GENERAL FUEL AND PROCESSES FOR MAKING THEM

TECHNICAL FIELD

This invention relates generally to synthetic fireplace general fuel or logs and methods of manufacturing them and, more specifically, to an improved form of such logs that have a solid core of various combinations of compressed forms of powdered coal/coke and other hydrocarbons and binders, and an outer shell of various forms of wood and binders to facilitate the initiation of combustion.

BACKGROUND OF THE INVENTION

There are several fire logs and processes for making such logs known in the prior art, but none of them employ the combination of a solid core of various combinations of compressed forms of powdered coal/coke and other hydrocarbons and binders and an outer shell of various forms of wood and binders to facilitate the initiation of combustion.

For example, U.S. Pat. No. 73,922 to PHILBRICK discloses a method of forming blocks comprised of various kinds of charcoal, bituminous or anthracite coal, rosin, coal tar, and hard or soft sawdust, all of which are mixed together in various proportions in accordance with a disclosed schedule while being heated. The composition is them pressed into blocks.

U.S. Pat. No. 912,554 to FOREMAN ET AL. forms fuel comprised entirely of wood.

U.S. Pat. No. 2,025,776 to ROBERTS ET AL. shows a method of making briquettes consisting of various forms of carbonaceous material such as coal, coke, sawdust, tan bark, peat, lignite, anthracite, carbonaceous residuums, and the like, all mixed together with a combustible binder.

U.S. Pat. No. 1,893,411 to KOMAREK ET AL. shows a briquette made entirely of bituminous and anthracite coal with a carbonized outer shell and an uncarbonized inner shell. Sulphite liquor is used an an initial binder, but bituminous coal becomes the permanent binder as the heating process continues.

U.S. Pat. No. 2,076,315 to ALBRECHT shows a method of forming fuel briquettes consisting entirely of powdered coal with a small amount of Portland cement used as a binder. A pair of paper discs are inserted at intervals in the formation of the briquettes which permit easy separation of the briquettes as they are cooled.

U.S. Pat. No. 2,136,591 to MacPHERSON discloses a method comprised entirely of coking coal formed from non-coking coal.

U.S. Pat. No. 2,215,536 to BETTE-BENNETT shows a method of making synthetic logs or bricks of fuel comprised entirely of pulverized coal held together by a suitable binder and then wrapped in a combustible covering such as paper or cellophane. The binder is comprised of sodium chloride, water, and asphalt.

U.S. Pat. No. 3,726,651 to RONDEN discloses a synthetic fireplace log and method for making. The log consists of charcoal, coal, and sawdust bound together with paraffin wax during a heating process.

U.S. Pat. No. 4,060,396 to BURTON shows a wafered fuel comprised entirely of compressed wood products. The wafers are disc shaped and separable.

It is an object of this invention to fabricate fuel logs with existing technology in a manner so as to make the logs a competitive, comparatively cheap, and efficient source of heat energy.

It is another object of the invention to provide a relatively new source of fuel at a relatively inexpensive cost.

Yet another object of the invention is to provide a new and unique method for utilization of former waste products to produce highly efficient and high energy output fuel logs.

Still another object is to provide a manufactured log that is an excellent source of emergency energy or, alternatively, can be used normally as fuel in fireplaces, fireplace inserts, heaters, furnaces, etc.

Another object is to provide a synthetic fire log that will withstand the ravages of the natural weather elements better than a log of wood or lump of coal or petroleum coke by itself and, therefore, can be stored in either inside or outside facilities.

It is yet another object to provide a manufactured log that can be packaged, displayed, and sold in any normal retail or wholesale outlet store, worldwide.

SUMMARY OF THE INVENTION

In accordance with a preferred embodiment of the invention there is provided a fabricated fuel log comprising a solid inner core having a given shape and formed of flammable coal and/or coal derived products and, if desired, other carbonaceous material and coated with a flammable wood derived material.

In accordance with one feature of the invention the outer coating or shell of this manufactured log (which shell typically can be about ¾" thick) can be of compressed wood, wood chips, sawdust, plywood, solid wood, or wooden slats or strips.

In accordance with another feature of the invention the inner core of the log (which typically can be about 3" in diameter) can consist of a solid rod of various types of coal, or combinations of particles of coal dust, wood, petroleum cokes (still bottoms), binders, and water.

Yet another feature of the invention is that the ¾" thick outer shell portion of this log will burn for approximately 30–45 minutes and thus ignite the inner core portion which will subsequently burn for approximately 2 to 2½ hours, leaving only a negligible amount of ash.

Another feature of the invention is that the overall heat output from the log will exceed 15,000 British Thermal Units (BTU) for a period of about one hour and will gradually decrease for another 1½ to 2 hours.

In accordance with yet another feature the outer wood or wood derived shell and the inner core can be formed simultaneously together or, alternatively, the outer shell can be formed separately from the inner core and then the outer shell and inner core combined, i.e., the outer shell and the inner core can be formed in one process and the inner core formed in another, separate process and the two units (outer shell and inner core) them combined together as a separate step to form the finished log.

Still another feature is that petroleum cokes can be used as the inner core. Petroleum cokes are a by-product of known gas and oil refining processes and, if processed properly, can be utilized as an efficient fuel with a BTU output of about 15,000 BTU's.

Another feature of the invention is that the outer wood or wood derived shell can be circumferentially or axially grooved to hasten the initial ignition of the outer surface of the log.

DETAILED DESCRIPTION OF THE INVENTION

The following detailed description of the logs and the methods of making them will be divided into two main sections. The first section will describe the various types of outer shells and processes for making them, and the second section will describe the various types of inner cores and the processes for making them, all in accordance with the following outline.

A. Processes For Making The Various Types Of Outer Shells

1. Process For Making Logs With Outer Shells Formed From Woodchips Or Sawdust (See FIG. 1.)
2. Process For Making Logs With Outer Shells Of Laminated Thin Sheets Of Wood (See FIG. 2)
3. Process For Making Logs With Outer Shells Of Strips Of Wood (See FIG. 3)
4. Process For Making Logs With Outer Shells Of A Solid Wood Tube (See FIG. 4)

B. Processes For Making The Various Types Of Inner Cores

1. Process For Making Inner Cores Of The Logs From Anthracite And Bituminous Coal (See FIG. 5)
2. Process For Making Inner Cores Of The Logs With Petroleum Coke, Also Known As "Still Bottoms" (See Fig. 6)
3. Process For Making Inner Cores Of The Logs With Mixture Of Petroleum Coke, Anthracite Coal, Bituminous Coal And Suitable Binders (See FIG. 7)
4. Process For Making Inner Cores Of The Logs With Mixture Of Petroleum Coke, Wood Chips, Anthracite Coal, and Bituminous Coal (See FIG. 8)

A. Processes For Making The Various Types of Outer Shells

1. The Outer Shell Formed By The Process Of FIG. 1

The cylindrically-shaped outer core for this log can be composed of wood shavings, wood chips, sawdust, plywood, wooden strips, or a drilled wooden shell, and suitable binders.

Figure 1:
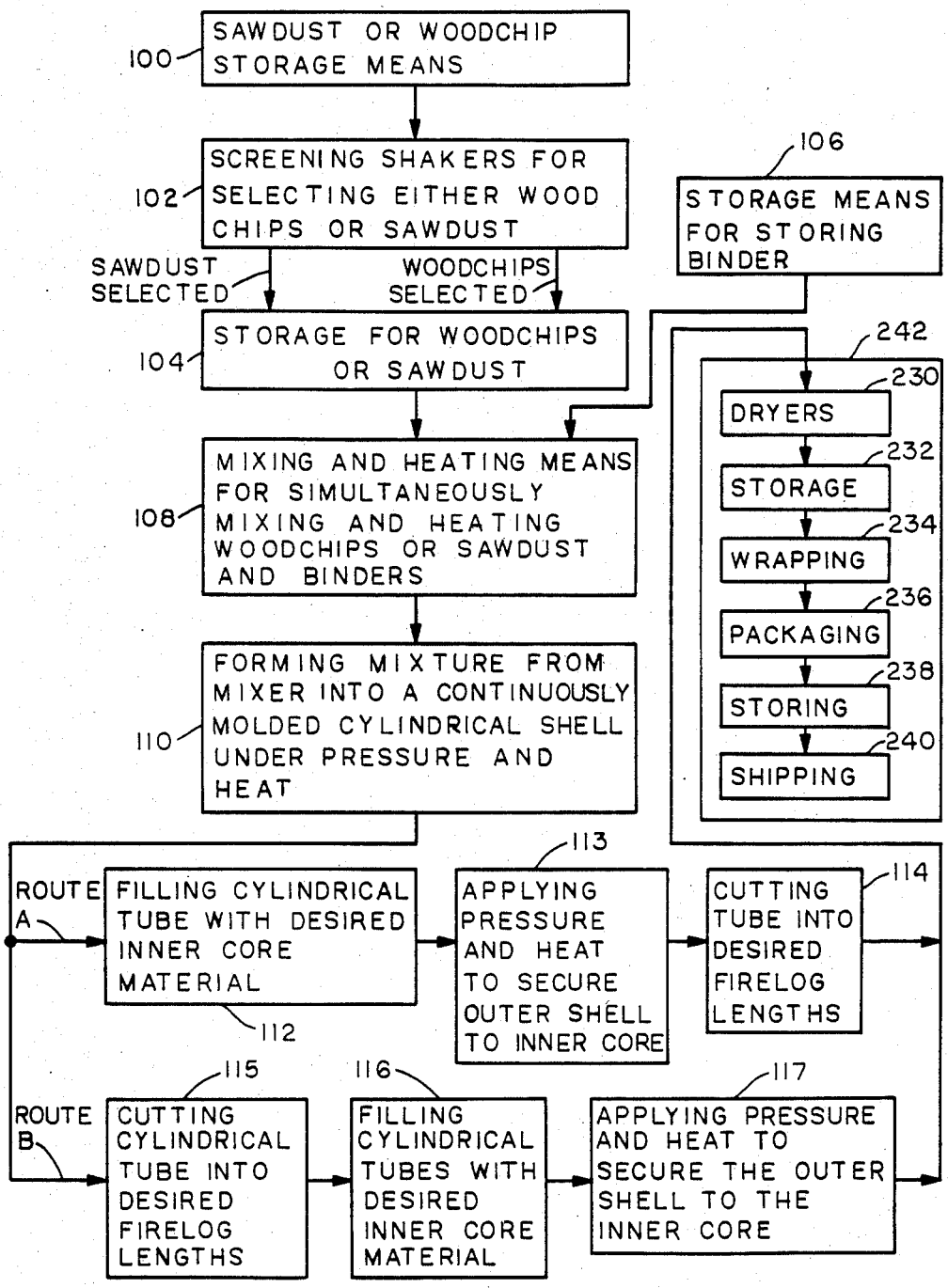
FIG. 1 shows a flowchart for a process for making the log outer shells of wood chips or sawdust, selectively, and with an appropriate binder.

If wood shavings, wood chips, or sawdust are used in combination, a suitable binder such as National #1215, pre-gelatinized starch, cellulosic food grade, or a positively charged cationic starch with a cellulosic base, or urea formaldehyde resin can be used in about 1–5% by weight amount to form a shell of hollow cylinder with a wall thickness of approximately $\frac{3}{4}$ inch. The inside diameter of the opening of the shell can be approximately 3 inches. These cylindrical shells of compressed wood derivatives can be formed on a continuous basis and cut to various lengths, as shown in FIG. 1, which will be discussed in detail later herein.

National #1215 pre-gelatinized starch is a pregelatinized (pre-cooked) cornstarch made and sold by the National Starch and Chemical Corporation of Bridgewater, N.J., and is described in Bulletin No. 256-F published by the National Starch and Chemical Corporation and incorporated herein by reference. The same aforementioned manufacturer makes and sells a number of different types of suitable cationic starches with a cellulosic base, described in various publications available from the aforementioned manufacturer and including Bulletin 132/78 entitled "CAT02", Bulletin 021683 entitled "FLOTEX 19", all of which are incorported herein by reference. Urea formaldehyde resin is described in most textbooks on resins.

2. The Outer Shell Formed By The Process Of FIG. 2

Figure 2:
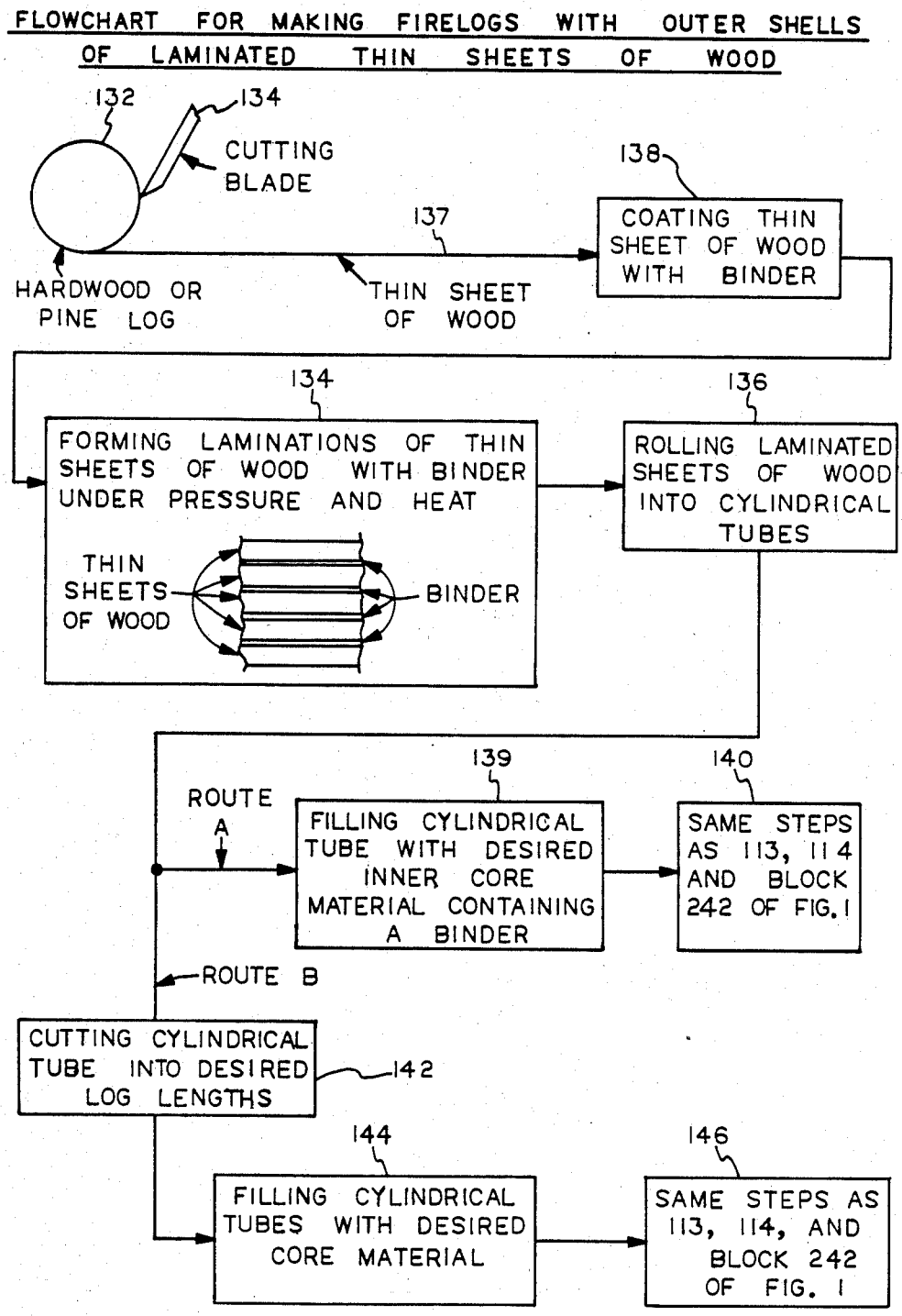
FIG. 2 shows a flowchart for a process for making the log outer shells of laminated thin sheets of wood.

If plywood is used as the outer shell material, standard plywood preparation procedures are used, but the individual plies are formed (laminated) under pressure with the same binders discussed above into a continuous tubular shell with a wall thickness of about $\frac{3}{4}''$. These formed tubular shells are then cut to any length from six inches up to thirty-six inches, as desired. The overall diameter can be about $4\frac{1}{2}$ inches. Reference is made to FIG. 2 which will be discussed in detail later herein.

3. The Outer Shell Formed By The Process Of FIG. 3

Figure 3:
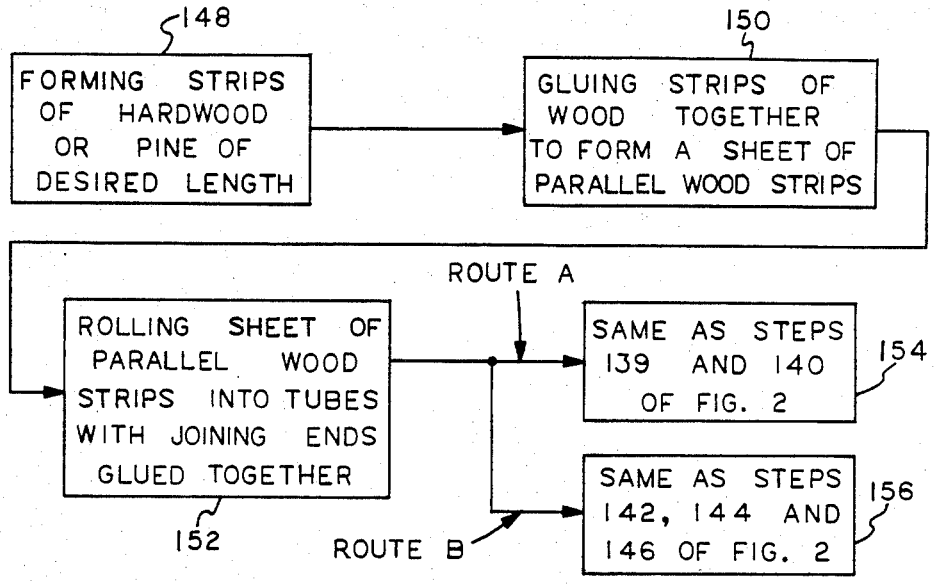
FIG. 3 shows a flowchart for a process for making the log outer shells of strips of wood.

If wood strips are used to form the outer shell, hardwood or pine strips (slats) with dimensions which typically can be $\frac{3}{4}'' \times \frac{1}{2}'' \times 48''$ are formed around a mold which can be about 3" in diameter. These strips are treated with the same binders as discussed above and then compressed so as to adhere to each other and form a cylindrical tube or cylinder about 48" in length, $\frac{3}{4}''$ thick with a 3" diameter opening. These formed shells can then be cut to various lengths, depending on the desired use. Reference is made to FIG. 3 which will be discussed in detail later herein.

4. The Outer Shell Formed By The Process Of FIG. 4

Figure 4:
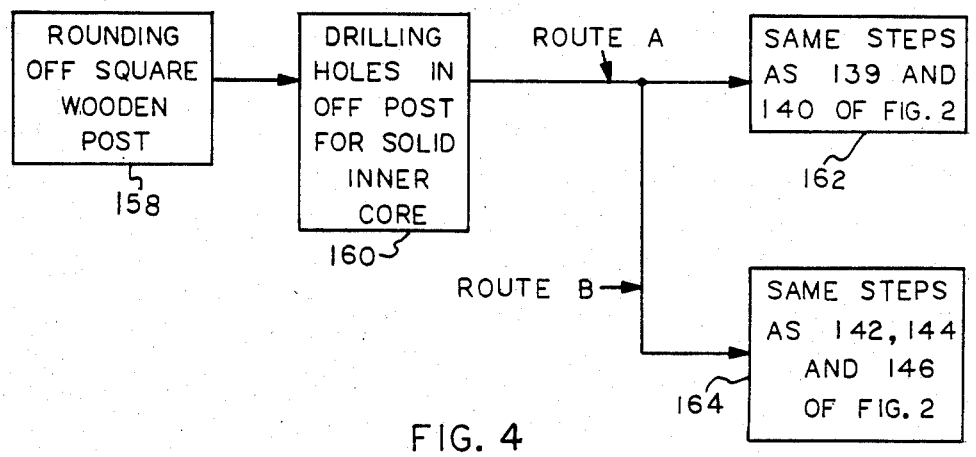
FIG. 4 shows a flowchart for a process for making the log outer shells of a solid wood tube.

If a drilled wooden core is used as the outer shell material, either hardwood or pine wood can be used as shown in FIG. 4. The wood can be sawed into $4\frac{1}{2}'' \times 4\frac{1}{2}'' \times 48''$ pieces. These pieces are then rounded down to about a $4\frac{1}{2}''$ outside diameter posts. These posts are then bored in the center thereof leaving a 3" diameter opening, and thus forming a solid wooden shell with a $\frac{3}{4}''$ thick wall. The shavings can be saved and utilized in the formation of the core which can be repacked into this drilled outer shell. The 48" lengths of bored-out wood shells can be cut to various lengths depending upon the type of facility to be used for incineration (i.e., fireplace, heaters, furnaces, etc.). There is no requirement for a binder in this process for forming the outer shell. The outer shell can be scored (grooved with $\frac{1}{4}''$ depth and width rotary cuts (axially or circumferentially) which will leave a rough surface on the outer surface of the shell to facilitate ignition of the manufactured log.

The physical and chemical ingredients employed in forming the outer shells for the above described four types of outer shells of the logs are as follows.

1 Outer Shell Made By The Process of FIG. 1
- a. Hardwood or pine shavings (i.e., chips or sawdust)
- b. Urea formaldehyde resin or National #1215 pregelatinized starch (cellulosic-food grade) 1–5% by volume weight
- c. Heat to 150 degrees to 200 degrees F.
- d. Pressure of 1200 to 1500 psi applied during heating.

2. Outer Shell Made By The Process of FIG. 2
- a. Plywood sheeting (laminations of continuous sheets
- b. Urea formaldehyde resin binder or National #1215 pre-gelatinized starch (cellulosic food grade)
- c. Heat to 150 degrees to 200 degrees F.
- d. Pressure 1000 to 1200 psi applied during heating 3. Outer Shell Made By The Process of FIG. 3
- a. Wooden strips (slats)
- b. Urea formaldehyde resin binder or National #1215 pre-gelatinized starch (cellulosic food grade) 1–5% by volume weight
- c. Heat to 150 degrees to 200 degrees F.
- d. Pressure of 1000 to 1200 psi applied during heating 4. Outer Shell Made By The Process of FIG. 4
- a. Drilled hardwood or pine shell made of hardwood or pine posts 4½" diameter×48" length Detailed descriptions of the processes for making the various outer shells of the firelogs are set forth below.

1. The Process of FIG. 1

Referring now to FIG. 1 a mixture of sawdust and woodchips from source 100 is supplied to screening shaker 102 where the sawdust or woodchips are selectively separated out and supplied to storage means 104. From storage means 104 the selected woodchips or sawdust is supplied to mixing and heating tank 108 along with binders from binder source 106 where the sawdust or woodchips and binders are mixed and heated to a slurry. The binder can be National #1215 Pre-Gelatinized Neutral Starch (Cellulosic) 1%–5% solution or one of the positively charge cationic starches.

The slurry is then formed into a cylindrically shaped tube or tube of some other desired configuration by a molding process under 1000 psi pressure at 150 degrees to 200 degrees F. by means of a suitable heater and a 10-ton hydraulic ram, for example, all represented generally by block 110 in FIG. 1. A suitable hydrulic ram is shown and described in U.S. Pat. No. 4,288,900, incorporated herein by reference.

It should be noted that the term "cylindrically shaped" as used herein means a tube with a continuous and uniformly shaped cross-sectional area which can be circular, square, rectangular, or some other desired configuration.

The finished outer shells can then be processed either by means of route A or route B.

In route A the long, cylindrical section is filled with the desired inner core material in block 112 and then heated under pressure in block 113 to solidify the inner core material and secure it to the outer core. Next, in block 114 the long section of log is cut into desired log lengths and processed successively through the steps shown in block 242 which consists of dryers 250, raw storage 232, wrapping 234, packaging 236, storing 238, and shipping 240.

In route B the long cylindrical section of outer core is first cut into sections of desired log lengths in block 115 and then filled with the desired inner core material in block 116.

These logs are then individually processed through the step of heating under pressure in block 117 followed by the steps within block 242.

2. The Process of FIG. 2

In FIG. 2 a wood log such as hardwood or pine log 132 is cut by blade 134 into a continuous thin sheet of wood 137 which is then coated with a suitable binder such as National #1215 in step 138 and then formed into a laminated thickness of wood as shown in block 134.

This laminated thickness of wood is then then rolled into a cylindrical tube or tubes have a wall thickness of about ¾", as shown in step 136.

Next, the cylindrical tubes are formed into logs with desired inner cores using the steps of either route A or route B of FIG. 2. In route A the long, cylindrical tube is first filled with the desired inner core material in step 139 and then is processed in the same manner as set forth in steps 113, 114, 115, and the several steps shown within block 242.

In route B the long cylindrical tube is first cut into the desired firelog lengths in step 142 before filling with the desired inner core material in step 144. Thereafter the process is the same as described with respect to step 242 of FIG. 1.

3. The Process Of FIG. 3

In FIG. 3 strips of wood such as hardwood or pine are formed in step 148 and glued together in step 150 to form a sheet of parallel wood strips. In step 152 the sheet of parallel strips are rolled into a tube of a cylindrical shape or other desired shape with the edges glued together.

The process of FIG. 3 is then the same as the processes of FIGS. 1 and 2 in that route A through step 154 or route B through step 156 can be followed. In route A the process is the same as steps 138 and 140 of FIG. 2 and in route B the process is the same as steps 144 and 146 of FIG. 2.

4. The Process of FIG. 4

In FIG. 4 a square post of wood such as pine or hardwood is rounded off in step 158 to a diameter of about 4½". Next, in step 160, a hole of 3" diameter is drilled through the axial length of the rounded off post to create a cylindrical tube with walls about ¾" thick.

Subsequently the process can follow route A through step 162 or route B through step 164 which correspond to the steps 154 and 156 in routes A and B, respectively, of the process of FIG. 3.

B. Methods For Making The Various Types Of Inner Cores

There are four basic types of inner cores of the logs described herein, as well as the four processes for making such four types of inner cores. These four basic processes for making the four inner cores are shown in FIGS. 5, 6, 7, and 8.

The basic materials used in the preparation of the four types of inner cores of the manufactured log are as follows.

1. For The Inner Core Made By The Process Of FIG. 5
- a. Anthracite coal
- b. Bituminous coal Binders-National #1215 pregelatinized starch-cellulosic-neutral binder
- c. Binders-National Cationic starches—a positively charged binder that attaches to the coal particles.

2. For The Inner Core Made By The Process Of FIG. 6

Petroleum coke is a by-product of the petroleum refining process. This product, when dry, will burn with about a 15,000 BTU output.

a. Ground petroleum coke (Still Bottoms)
b. Binders (Same as in 1C above)
c. Water 3. For The Inner Core Made By The Process of FIG. 7
a. Ground petroleum coke
b. Anthracite coal
c. Bituminous coal
d. Binders (same as in 1 c above)
e. Water 4. For the Inner Core Made By The Process of FIG. 8
a. Ground petroleum coke
b. Wood chips
c. Anthracite coal
d. Bituminous coal
e. Binders (Same as in 1 c above)
f. Water In the following paragraphs there is set forth detailed descriptions of the four processes of FIGS. 5, 6, 7, and 8.

1. The Process Of FIG. 5

Figure 5:
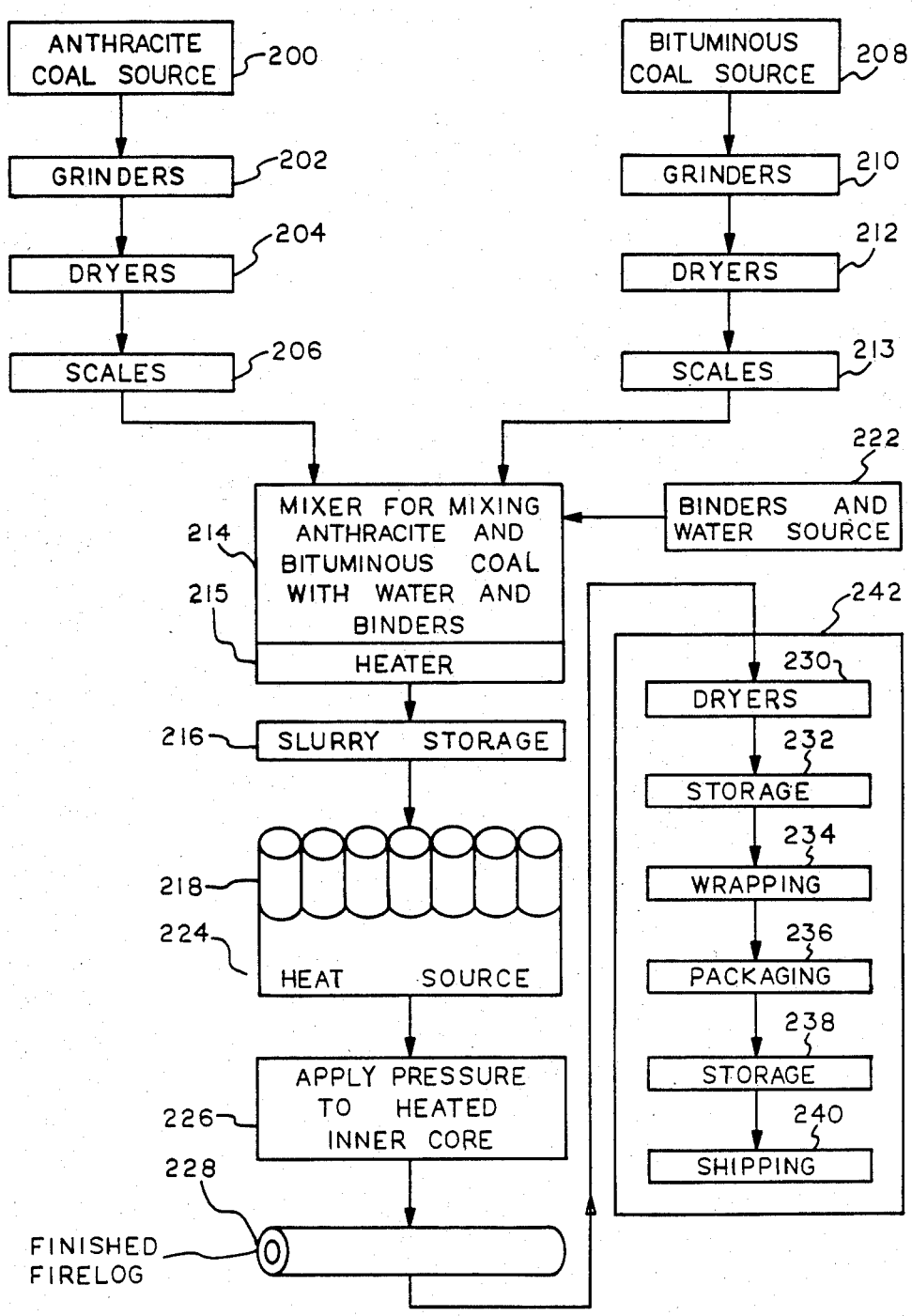
FIG. 5 shows a flowchart for making the inner cores of the logs from anthracite, bituminous coal, and suitable binders.

Referring now to FIG. 5 a mixture of anthracite coal from source 200 and bituminous coal from source 208, after being ground and dried in grinders 202 and 210, respectively, and dryers 204 and 212, respectively, and weighed by scales 206 and 213, respectively, is mixed in mixer 214 with water and a binder such as National's #1215 (pre-gelatinized starch cellulosic) or any one of many cationic (positively charged) starch binders from binder and water source 222 in the ratio of about 1/5% volume by weight to form a slurry. More specifically, this slurry mixture is thoroughly mixed in mixer 214 and concurrently heated by heater 215 to approximately 100 to 125 degrees F. for approximately 4–5 minutes. The resulting malleable slurry is accumulated in storage tank 216 and then poured into pre-formed and pre-cut sizes of selected outer log shells contained in rod core molds 218. Then the inner core clurry mixture within the selected log shells and also the outer shells within the rod core mold 218 are heated by heater 224 to 150 to 200 degrees F. and placed under approximately 1000 psi pressure in step 226 (using a hydraulic ram pressure of 10 tons, for example) for approximately 30–45 seconds. This will allow the malleable slurry of coal and binder to become solidified and bound together to form a finished log 228 with a moisture content of approximately 14% by weight.

The outer composition wood log shell and its newly formed inner core is then placed in dryers (drying oven) 230, or run through a series of dryers via a conveyor belt (not shown) for approximately 15 minutes. The drying procedure will bring the net moisture content of the formed log down to approximately 4% by weight. Additional drying can occur while the product is in storage 232, prior to wrapping 234, if desired. The log is then packaged in step 236, stored in step 238, and finally shipped to distributors in step 240.

In summary, a selected log outer shell is pre-formed as shown in one of FIGS. 1–4 above. The inner core mixture is poured into the selected outer shell and pressure and heat applied until the inner core material hardens. Thus, a manufactured log 228 is formed with a wood or wood derivative outer shell ¾" thick, and an inner core (about 3" diameter) made of compressed varieties of coal, coal dust, coke, and binders. The outside of the log can be grooved (about ¼" deep grooves) for faster ignition, if desired.

2. The Process Of FIG. 6

There exists today a by-product from the petroleum refining process which is known as petroleum coke and also called still-bottoms. This material is a hard residue that is formed during the gasoline refining and distillation process and is in abundant supply wherever gasoline or fuel oil is refined. As of this date, no known use is being made of this by-product.

This still-bottoms by-product is converted into an inner core material which can be employed in the manufactured log of the present invention and will burn with about a 15,000 BTU output, leaving very little, almost neglibible ash content.

The following paragraphs describe the process shown in FIG. 5 which is employed to form this heretofore unused material into a suitable inner core for the manufactured log.

As shown in FIG. 5 the petroleum coke stored in reservoir 300 is supplied to grinder 302 where it is ground to pass through the 40 Screen-200 Mesh Screen of block 304, and then dried in dryer 306, stored in storage bin 308, and then supplied to mixer 314 along with a binder, such as National #1215 pre-gelatinized starch, or one of the many cationic starches available from binder source 310. The mixture is then heated to 150 to 200 degrees F. by heater 316 (and simultaneously mixed) until the mixture is thoroughly saturated with the binder. Water is then added from water source 312 until the consistency of the slurry mixture is similar to that of mason's brick mortar. This malleable mass of petroleum coke, binder, water, and starch is then poured into 3" diameter × 48" length molds 318. The filled molds are then heated to a temperature of 150 to 200 degrees F. by means of an electrical strip heater 320, for example. Simultaneously, approximately 1000 psi is applied to the molds 318 with a 10 ton hydraulic ram press shown generally as block 324 for a period of approximately 30–45 seconds. When the material is removed from the mold as shown in block 326, it will have the same consistency as chunk coal but will be in a solid 3" diameter rod form as shown in block 326. This rod of inner material can then be inserted into any of the 48" length, 3" inside diameter pre-formed outer wood or wood derived outer shells described earlier herein.

By applying a light coating of National #1215 starch binder to the outside of the inner core, it will adhere snugly to the outer shell. Another way that this inner core material can be formed is by the same method used in FIG. 5, i.e., the malleable petroleum coke mass can be poured into the pre-formed wood or wood fiber shell, then placed under 150 to 200 degree F. heat and 1000 psi (using a 10 ton hydraulic ram pressure). Thus, the inner core 3" diameter can be formed within the outer core. The result will be a ¾" thick outer wood or wood derivative shell with a 3" inner core of solid petroleum coke. The outer wood will ignite and burn for approximately 30–45 minutes while simultaneously the inner core will be ignited uniformly and continue to burn for approximately 2 to 2½ hours leaving a negligible amount of ash content. The surface of the log can be circumferentially or axially grooved with ¼" grooves for faster ignition, if desired.

3. The Process Of FIG. 7

Figure 7:
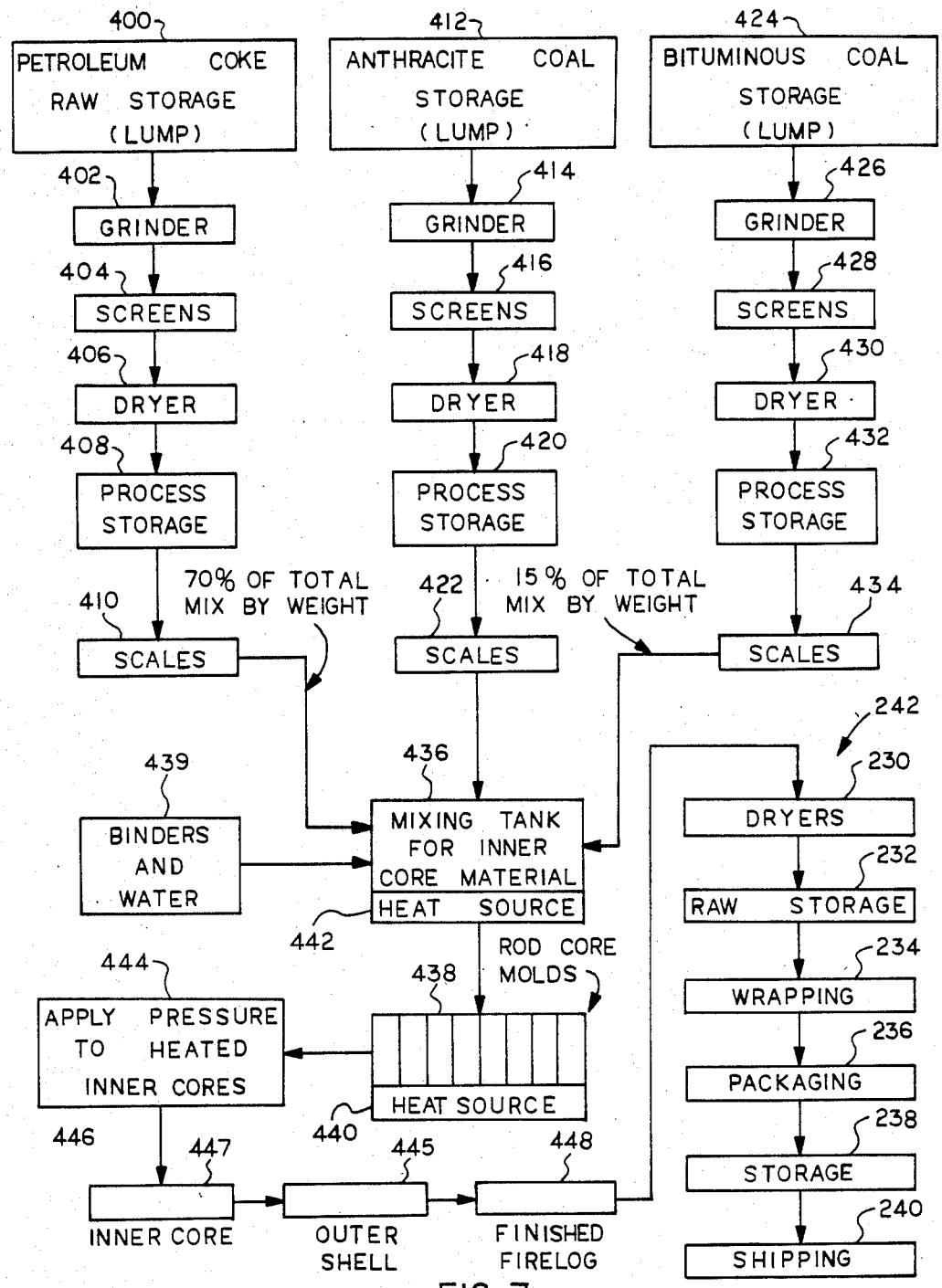
FIG. 7 shows a flowchart for making the inner cores of the logs with a mixture of petroleum coke, anthracite coal, bituminous coal, and suitable binders.

In FIG. 7 a mixture of 70% petroleum coke from source 400, 15% anthracite coal from source 412, and 15% bituminous coal from source 424, all by weight, are mixed together in mixing tank 436 along with binders and water from source 439. Before mixing, however, the petroleum coke, the anthracite coal, and the bituminous coal are each processed through grinders 402, 414, and 426, respectively, screens 404, 416, and 428, respectively, dryers 406, 418, and 430, respectively, storage means 408, 420, and 432, respectively, and weighed on scales 410, 422, and 434, respectively, to determine the proper proportions of petroleum coke, anthracite coal, and bituminous coal, respectively.

The binders from source 439 can be National #1215 pre-gelatinized starch or positively charged National cationic starch.

The mixture in mixer 436 is heated by heat source 442 to a temperature of 150 to 200 degrees F. and mixed until the mixture is thoroughly saturated with the binder (and water) from binder source 439.

The mixed and heated slurry is then poured into the rod core molds 438 which can, if desired, already contain the desired type outer shell.

The filled rod core molds are then heated by heat source 442 to a temperature of 150 to 200 degrees F. for about 30–45 seconds. Simultaneously with the heating the filled rod core molds 438 are placed under 1000 psi by a hydraulic ram press indicated generally by block 444.

The resulting logs, shown in block 446, consist of the outer shell 445 into which the inner core 447 is inserted, i.e., if the outer shell was not placed in the rod core molds 436 in an earlier step in the process. The resultant, completed log is identified by reference character 448.

It is to be understood that if only the inner core is formed in rod core molds 438 such inner core should be coated with a binder before being inserted in the outer shell 455, as shown in block 446.

Figure 6:
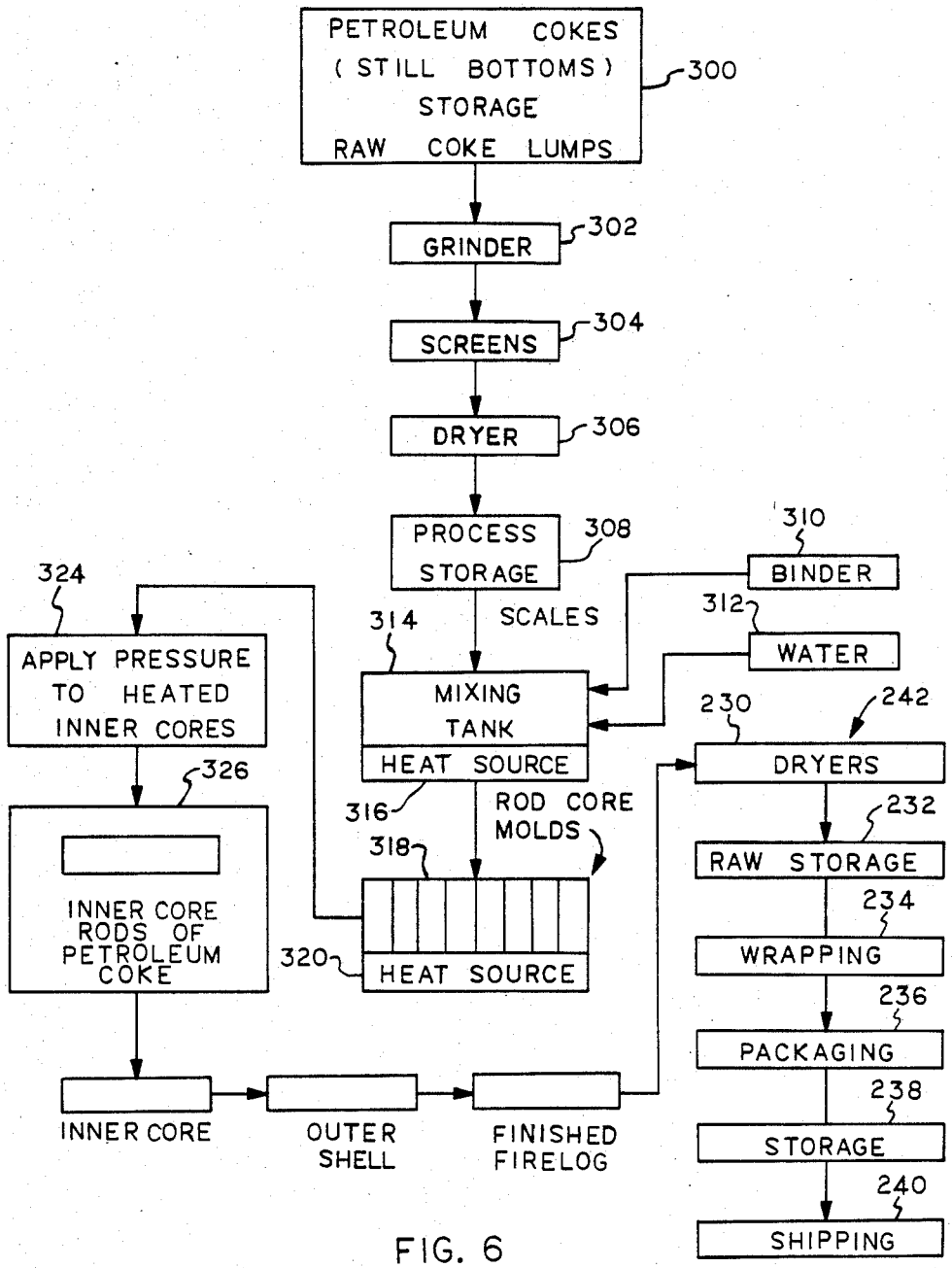
FIG. 6 shows a flowchart for making the inner cores of the logs from petroleum coke (still bottoms) and suitable binders.

The completed log is then processed by the steps shown in block 242, which corresponds to the steps in blocks 242 of FIGS. 5 and 6.

4. The Inner Core Formed By The Process Of FIG. 8

Figure 8:
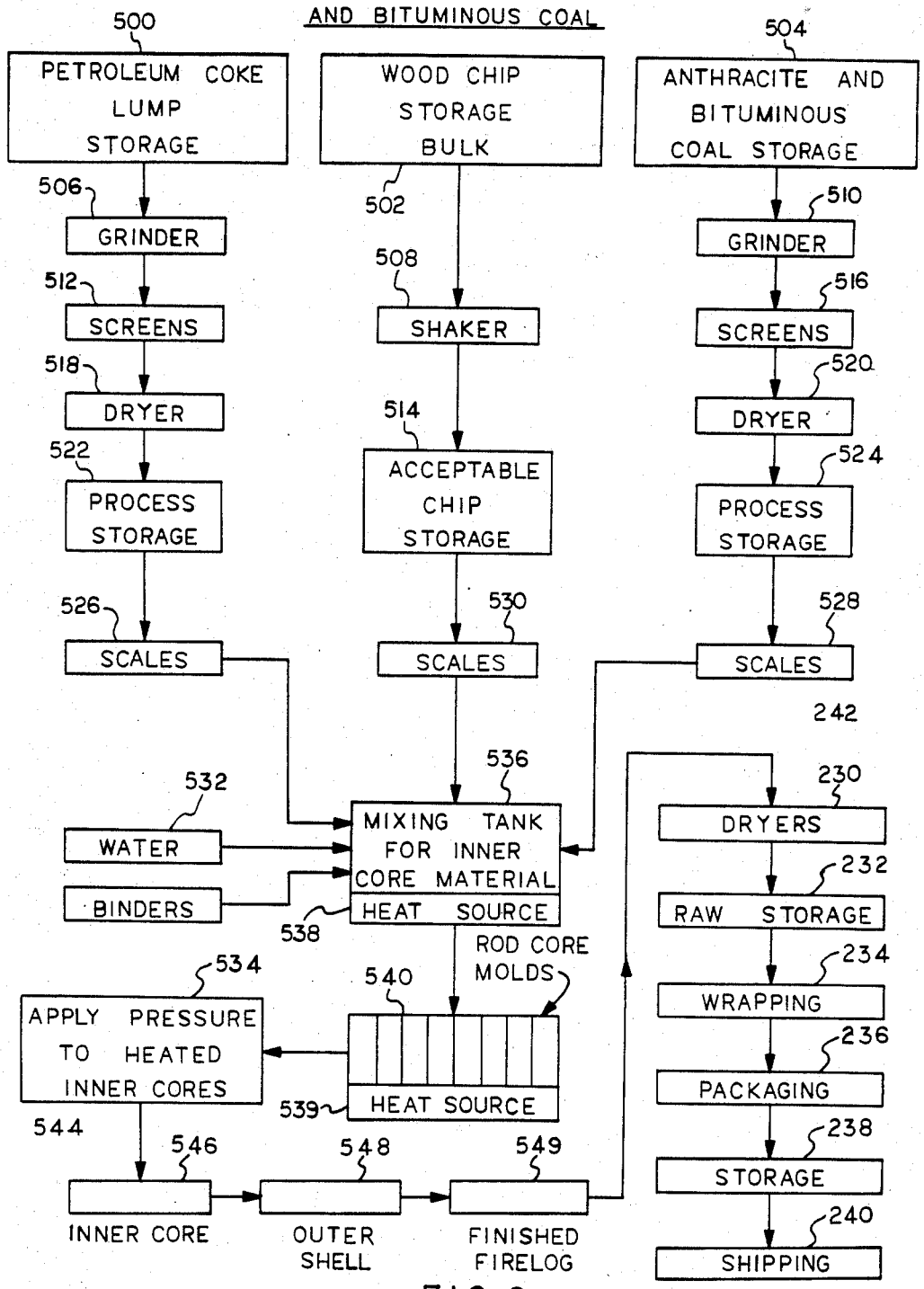
FIG. 8 shows a flowchart for making the inner cores of logs with a mixture of petroleum coke, wood chips, anthracite coal, and suitable binders.

In the flowchart of FIG. 8 petroleum coke from source 500, wood chips from source 502, and a combination of anthracite and bituminous coal from source 504 are combined, after certain processing to be described below, the mixer 536 along with water and binders from sources 532 and 534, where they are all mixed together while being heated to 150 to 200 degrees F. by heater 538.

Before mixing, however, the petroleum coke and the anthracite and bituminous coal from sources 500 and 504 are processed through grinders 506 and 510, respectively, screens 512 and 516, respectively, dryers 518 and 520, respectively, storage means 522 and 524, respectively, and then weighed on scales 526 and 528, respectively.

The woodchips from source 502 are processed through shakers 508 to remove sawdust, a storage means 514, and weighed on scales 530 before being supplied to mixer 536.

After heating and mixing, the resultant slurry is poured into rod core molds 540, which can already contain the selected outer shell, if desired. The mold 540 is heated to 150 to 200 degrees F. by heater 539. Simultaneously, a pressure of 1000 psi is applied by a ram type pressure machine contained in block 542.

The resultant inner core 546, shown in block 544, is coated with a binder and inserted into outer shell 548 to form the completed log 549.

If the outer shell is first inserted into mold 540 then the completed log is formed in the mold 540.

The completed log is then processed through the steps of block 242, which are the same steps as described in connected with FIGS. 5, 6, and 7.

Figure 9:
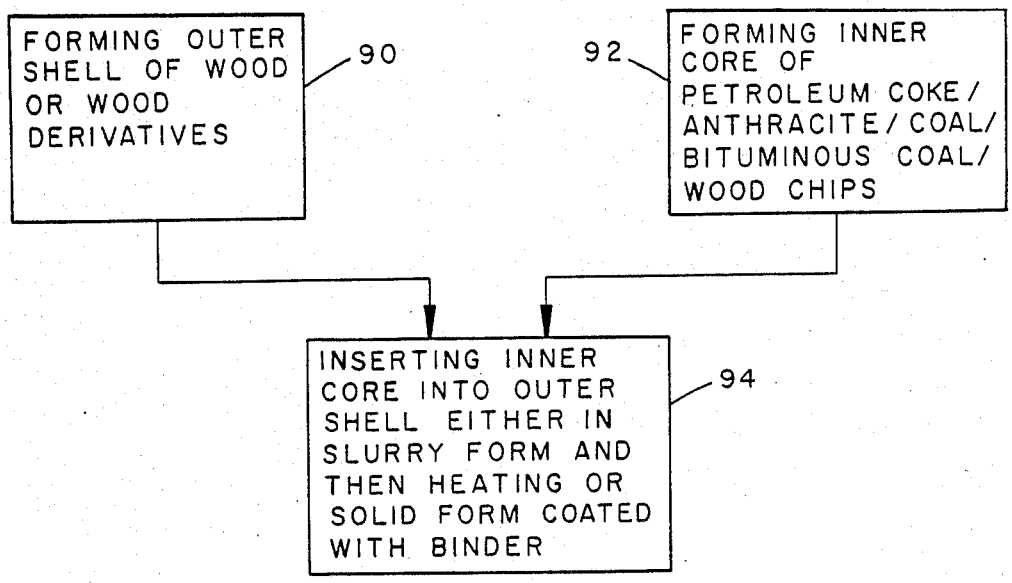
FIG. 9 shows a borad, conceptual diagram of the invention.

In FIG. 9 there is shown in general form the overall process of making the logs. From the prior descriptions of FIGS. 1–8 it can be seen that an outer shell is formed in block 90 and an inner core in block 92. The inner core and outer shell are then combined in step 94 to form the completed log.

It is to be understood that the forms of the invention shown and described herein, both products and processes, are but preferred embodiments thereof and that other forms thereon will be apparent to one of ordinary skill in the art.

I claim:

1. A process for making a synthetic log for use in a fireplace or for general fuel purposes comprising the steps of:

forming a cylindrically shaped inner core of given length suitable for fireplaces, wood stoves, and the like, and comprised of particles of petroleum coke and bituminous coal or anthracite coal, or combination thereof, and held together by a suitable flammable binder;

forming a cylindrically shaped outer shell of said given length and of a cross sectional inner shape to receive a selected one of said inner cores, and comprised of a selected one of wood chips or sawdust, or a combination thereof, a laminated sheet of wood formed into a cylindrical shape, strips of wood glued together and formed into said cylindrical shape, or a piece of wood bored out to have a cross-sectional bored-out area of said cylindrical shape and size; and filling any selected one of said outer shells with any selected one of said inner cores.

2. A process as in claim 1 comprising the further steps of:

initially forming said inner core into a slurry;

pouring said slurry into the selected outer shell; and simultaneously heating and applying pressure to said slurry filled outer shells until said slurry forms into a solid inner core having the configuration of the volume defined by said outer shell.

3. A process as in claim 1 comprising the further step of:

applying heat and pressure to said log to securely bind together the outer core and the inner core and the ingredients thereof and to lower the moisture content of said log.

4. A process for making synthetic fuel logs comprising the steps of:

making a first slurry of wood chips or sawdust, or a combination thereof, and binders;

molding and heating said first slurry into an outer shell defining a volume therein of a given configuration and size;

making a second slurry of uniform consistency and comprised of particles of coal, petroleum coke, or coke, or a combination thereof, and a binder and water;

pouring said second slurry into said outer shell; and heating and applying pressure to said slurry filled outer shell to solidify said slurry into a solid inner core within said outer shell and securely bound thereto.

5. A process for making a synthetic generally cylindrically shaped fuel log comprising the steps of:

forming an outer shell of wood or pieces of wood products, and a binder to bind together said pieces of wood and defining a volume having a smaller generally cylindrical shape and size; and forming an inner core of petroleum coke in combination with coal derivatives, or other flammable carbonaceous material and having said smaller generally cylindrical shape, and securely securing said inner core within said outer shell to form a firelog having said generally cylindrical shape.

6. A process as in claim 5 comprising the further steps of:

initially forming said inner core into a slurry;

pouring said slurry into the selected outer shell; and simultaneously heating and applying pressure to said slurry filled outer shell until said slurry forms into a solid inner, core having the configuration of the smaller generally cylindrically shape defined by said outer shell.

7. A process as in claim 5 comprising the further step of:

applying heat and pressure to said log to further securely bind together the outer shell and the inner core and the ingredients thereof and to lower the moisture content of said log.

* * * * *